US010441862B2

(12) United States Patent
Yip

(10) Patent No.: US 10,441,862 B2
(45) **Date of Patent: *Oct. 15, 2019**

(54) AUTOMATIC SCORING SYSTEM FOR BEER PONG GAME AND ONLINE BEER PONG GAME SYSTEM

(71) Applicant: Atalon IP Limited, Kwun Tong (HK)

(72) Inventor: Steven Ka Hing Yip, Kowloon (HK)

(73) Assignee: Atalon IP Limited, Kowloon (HK)

( * ) Notice: Subject to any disclaimer, the term of this patent is extended or adjusted under 35 U.S.C. 154(b) by 0 days.

This patent is subject to a terminal disclaimer.

(21) Appl. No.: 15/557,815

(22) PCT Filed: Jul. 6, 2017

(86) PCT No.: PCT/CN2017/091946

§ 371 (c)(1),
(2) Date: Sep. 13, 2017

(87) PCT Pub. No.: WO2018/010590

PCT Pub. Date: Jan. 18, 2018

(65) Prior Publication Data

US 2019/0126115 A1 May 2, 2019

(30) Foreign Application Priority Data

Jul. 12, 2016 (CN) ..... 2016 1 0544425

(51) Int. Cl.
*A63F 9/24* (2006.01)
*A63B 67/06* (2006.01)
(Continued)

(52) U.S. Cl.
CPC ..... *A63B 67/066* (2013.01); *A63B 63/08* (2013.01); *A63B 67/002* (2013.01);
(Continued)

(58) Field of Classification Search
CPC ..... A63B 2067/061; A63B 2225/54; A63B 2225/682; A63B 63/08; A63B 67/06;
(Continued)

(56) References Cited

U.S. PATENT DOCUMENTS 8,282,457 B1 * 10/2012 Edwards ..... A63B 71/06 273/309
9,740,899 B1 * 8/2017 Shah ..... G06K 7/10415
(Continued)

*Primary Examiner* — Justin L Myhr
(74) *Attorney, Agent, or Firm* — Muncy, Geissler, Olds & Lowe, P.C.

(57) ABSTRACT

The present invention discloses an automatic scoring system for a beer pong game to implement an automatic scoring function of the beer pong game using a radio frequency identification (RFID) technology, comprising: a game table equipped with a RFID reader and a plurality of RFID antennas; a plurality of game cups with electronic tags being attached at bottoms thereof; at least one game ball with an electronic tag embedded therein, and a computer that processes data read by the reader from the electronic tags and controls a scoring procedure of the beer pong game, wherein the RFID antennas are placed at a plurality of predetermined positions in a game zone of the game table, the plurality of predetermined positions corresponding to possible positions of the game cups placed according to game rules. The present invention also discloses an online beer pong game system, comprising the automatic scoring system for a beer pong game as mentioned above, which online beer pong game obtains game data in real-time from a computer of the automatic scoring system using a cloud storage technology and a mobile phone application, such that competitors of the beer pong game can online participate in the game, track game scores and statistics, compare results with other competitors on a global scale.

12 Claims, 9 Drawing Sheets

(51) Int. Cl.

| | |
|---|---|
| ***A63B 71/06*** | (2006.01) |
| ***A63F 7/00*** | (2006.01) |
| ***A63F 7/30*** | (2006.01) |
| ***A63B 63/08*** | (2006.01) |
| ***A63B 67/00*** | (2006.01) |

(52) U.S. Cl.
CPC ..... *A63B 71/0605* (2013.01); *A63B 71/0669* (2013.01); *A63F 7/00* (2013.01); *A63F 7/30* (2013.01); *A63B 2225/54* (2013.01); *A63B 2225/682* (2013.01); *A63F 2250/024* (2013.01)

(58) Field of Classification Search
CPC ..... A63B 71/0605; A63B 71/0669; A63F 2250/024; H04B 5/0062
See application file for complete search history.

(56) References Cited

U.S. PATENT DOCUMENTS

| | | | | |
|---|---|---|---|---|
| 2002/0113123 | A1* | 8/2002 | Otto | G06K 17/0022 235/381 |
| 2004/0212480 | A1* | 10/2004 | Carrender | G06K 7/0008 340/10.42 |
| 2006/0027971 | A1* | 2/2006 | Radhakrishnan | A63B 67/002 273/309 |
| 2007/0075873 | A1* | 4/2007 | Yang | G01S 5/0226 340/8.1 |
| 2012/0013073 | A1* | 1/2012 | Wyland | A63B 67/002 273/287 |
| 2013/0085018 | A1* | 4/2013 | Jensen | A63B 57/00 473/404 |
| 2014/0151964 | A1* | 6/2014 | Alway | A63B 63/08 273/371 |

* cited by examiner

AUTOMATIC SCORING SYSTEM FOR BEER PONG GAME AND ONLINE BEER PONG GAME SYSTEM

FIELD OF THE INVENTION

The present invention relates to an online beer pong game system, and specifically relates to an automatic scoring system for a beer pong game and an online beer pong game system having the automatic scoring system.

BACKGROUND OF THE INVENTION

The beer pong game has its origins within the drinking culture of fraternities of Dartmouth College in the 1950s and 1960s, and now has become a popular drinking game in youth culture. The earliest version resembled much a ping-pong game, except that one or several beer cups are placed on each side of a table. A standard bear pong table is usually a typical ping-pong table; but any oblong table is feasible. Some people will use a plastic table with foldable legs, some people will make a table with wood by themselves, and some people will ingeniously build their own beer pong tables to exhibit their artistic talents on the tabletop. Now, the beer pong game has been evolved into a competitive sport from a table game. Without restrictions in age and gender and with less demanding on physical strength, the game can be played from children to seniors and thus wins worldwide population.

The beer pong game has many local rules. Game rules and equipment are possibly different in various places. However, when playing the beer pong game during drinking, 6 or 10 beer cups are generally arranged into a triangle formation at each end of a long table like a ping-pong table; the beer pong game typically consists of two teams. When a ball successfully lands in a cup, the defending team shall drink all beer in the cup, and then that cup will be removed. The first team whose cups are completely removed loses the game, while the losing team has to consume all bear in the remaining cups of the winner. Considering that players need to directly contact the ball during the game or competition and the ball also likely falls on the ground, for sanitary reasons, e.g., in a drinking game in a bar, the competition part of the beer pong game already uses water instead of traditional beer, and the players drink beer or alcohol or carry out other entertainment activities otherwise based on a result of the game.

However, the beer pong games in the current market do not have a function of automatic scoring. It is relied on the players' naked eyes to judge whether a ball is landed. Therefore, the beer pong games cannot be actually played electronically. Consequently, the existing beer pong games cannot automatically play music or display an animation after a player successfully lands a ball like other common electronic game machines to evoke the ambience of game and enhance the fun of playing the game. Besides, the teams can only start a beer pong game at the same location. They cannot remotely participate in the beer pong game like other online network games. Further, game data such as results of players in a round cannot be stored in the cloud in real time; therefore, ranking and grading cannot be done based on game results like many current online network games.

SUMMARY OF THE INVENTION

An objective of the present invention is to provide an automatic scoring system for a beer pong game and an all-electronic beer pong game system having an automatic scoring function, which implements an automatic scoring function of the beer pong game using a radio frequency identification (RFID) technology, thereby overcoming various inconveniences and restrictions mentioned above in the existing beer pong games. In addition, the present invention further integrates a cloud storage technology and a smart phone application based on the automatic scoring function, thereby providing an online beer pong game system enabling users to remotely participate in the game.

In order to achieve the above objective, a technical solution of the present invention discloses an automatic scoring system for a beer pong game, which implements an automatic scoring function of the beer pong game using a radio frequency identification (RFID) technology, comprising: a game table equipped with a RFID reader and a plurality of RFID antennas; a plurality of game cups attached with electronic tags at bottoms thereof; at least one game ball with an electronic tag embedded therein, and a computer that processes data read by the reader from the electronic tag and controls a scoring procedure of the beer pong game, wherein the RFID antennas are disposed at a plurality of predetermined positions in a game zone of the game table, the plurality of predetermined positions corresponding to possible positions of placing the game cups according to a game rule.

Preferably, in the automatic scoring system for a beer pong game, the electronic tags of the game cups are dimensioned to be positioned only in working zones of the respective RFID antennas; the electronic tag of the game ball is dimensioned such that the electronic tag of the game ball landing into the game cup and drifting on a liquid surface is only positioned within a working zone of the corresponding RFID antenna.

Preferably, in the automatic scoring system for a beer pong game, respective electronic tags of the game cups and the game ball are all 13.56 MHz high-frequency passive tags in compliance with the ISO15693 Standard, and dimensions of the electronic tags of the game cups are far smaller than a dimension of the electronic tag of the game ball.

Preferably, in the automatic scoring system for a beer pong game, a data storage format identifier (DFSID) and an application family identifier (AFI) of the electronic tag for the game cup are different from those of the electronic tag for the game ball, such that the RFID reader can only read the electronic tag of the game cup or the electronic tag of the game ball, and can determine, based on information returned from the electronic tag, whether the electronic tag belongs to the game cup or the game ball.

Preferably, in the automatic scoring system for a beer pong game, when a single RFID antenna of the RFID reader identifies the electronic tag of the game cup and the electronic tag of the game ball at the same time, the computer determines that the game ball lands into the game cup and automatically scores according to the game rule; when a plurality of RFID antennas of the RFID reader simultaneously identify the electronic tag of the game ball, the computer determines that the game ball does not land into the game cup and then does not count a goal.

Another technical solution of the present invention discloses an online beer pong game system, comprising the automatic scoring system for a beer pong game as mentioned above, which online beer pong game obtains game data in real-time from a computer of the automatic scoring system using a cloud storage technology and a mobile phone application, such that competitors of the beer pong game can online participate in the game.

Preferably, the online beer pong game system further comprises a light control sub-system, an information displaying sub-system, and/or a sound control sub-system to correspondingly perform lighting, animation display, and/or sound effect in coordination with a scoring result of the automatic scoring system.

A further technical solution of the present invention discloses a beer pong game cup specifically for the automatic scoring system for a beer pong game, an electronic tag being attached at a bottom of the beer pong game.

A still further technical solution of the present invention discloses a beer pong game ball specifically for the automatic scoring system for a beer pong game, an electronic tag being embedded inside the beer pong game ball.

A yet further technical solution of the present invention discloses a beer pong game table specifically for the automatic scoring system for a beer pong game, the beer pong game table being equipped with a RFID reader and a plurality of RFID antennas.

According to the technical solutions of the present invention, by integrating lighting effect, sound effect, animation display, game control, account management, and automatic scoring technology into the online beer pong game, after a specific mobile phone application is downloaded, a competitor does not simply end a game after playing one round; as long as he/she logs on and accesses the mobile phone application before start of the game, the score of the competitor in each round will be automatically recorded and stored in the cloud, such that he/she can compete with competitors from different places in the world through a ranking list. The online beer pong game according to the technical solutions of the present invention provides a fresh and in-depth game experience which is more interactive, interesting and convenient to play for competitors. In this way, a new beer pong game network is constructed, which breaks the specifications and restrictions of traditional beer pong games and may promote the beer pong game culture throughout the world.

The features, technical effects and other advantages of the present invention will become more obvious in combination with further illustration of the accompanying drawings below.

BRIEF DESCRIPTION OF THE ACCOMPANYING DRAWINGS

Hereinafter, the present invention will be described through examples with reference to the accompanying drawings, wherein.

Figure 2A:
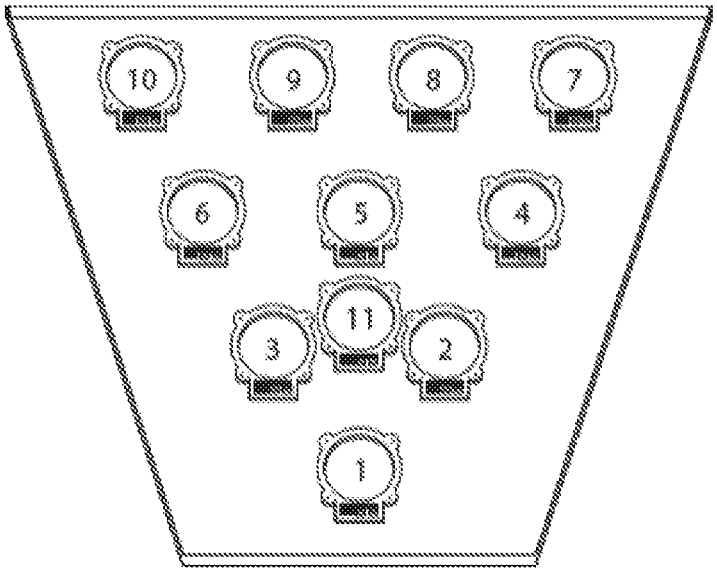
Figure 2B:
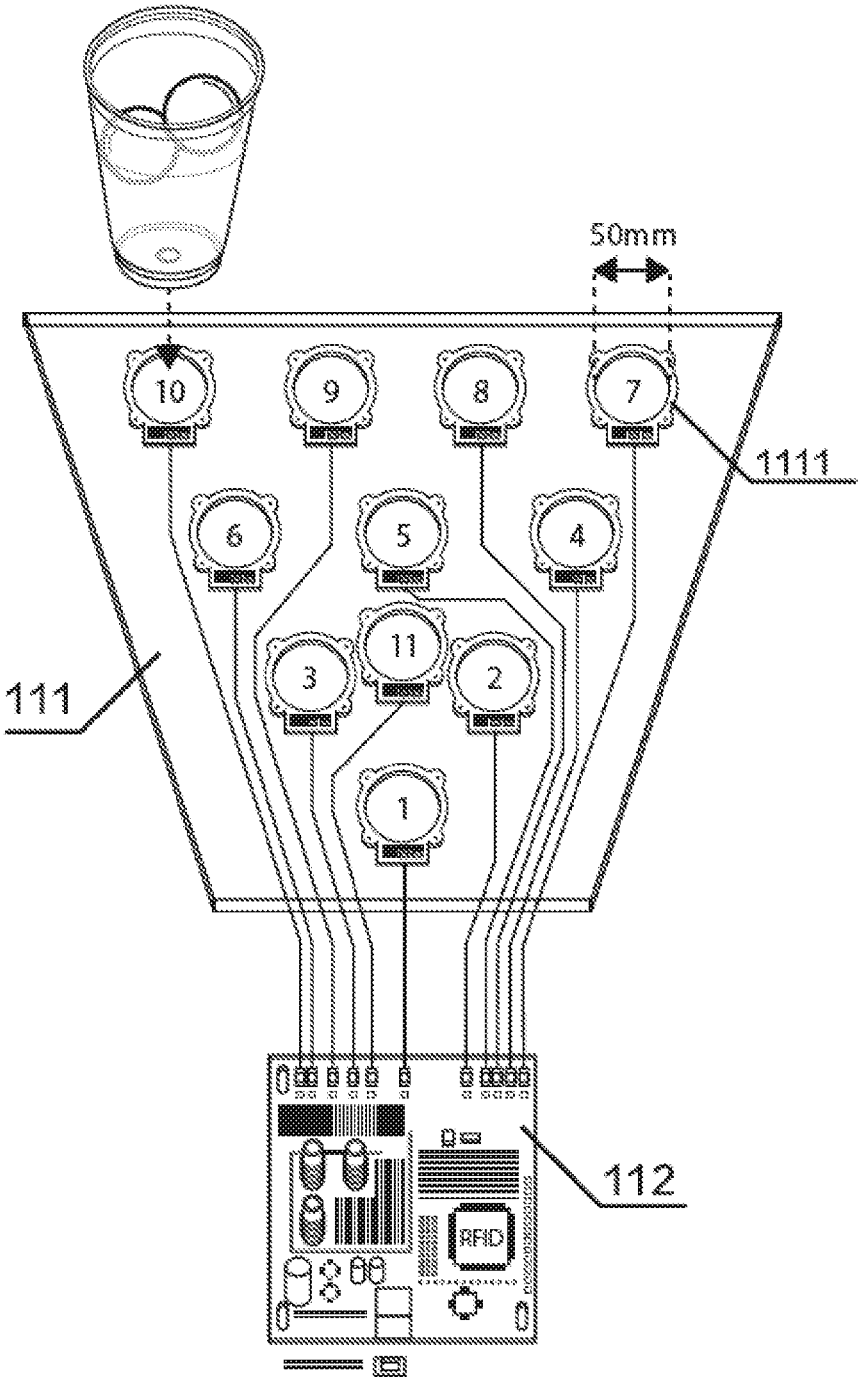

FIGS. 2A and 2B schematically illustrate a ball-landing detecting sub-system of a beer pong game system of the present invention.

Figure 3:
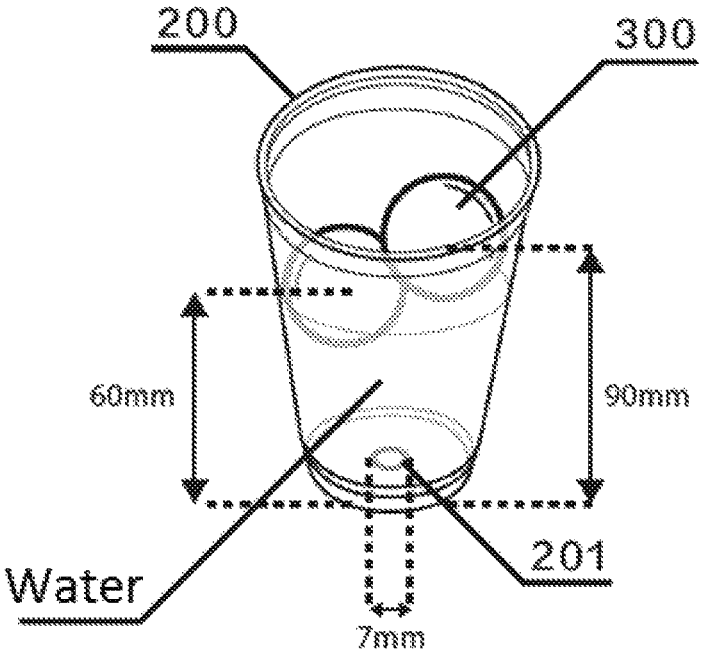

FIG. 3 illustrates a schematic diagram of a usage state of a game cup in the ball-landing detecting sub-system of FIG. 2B.

Figure 4:
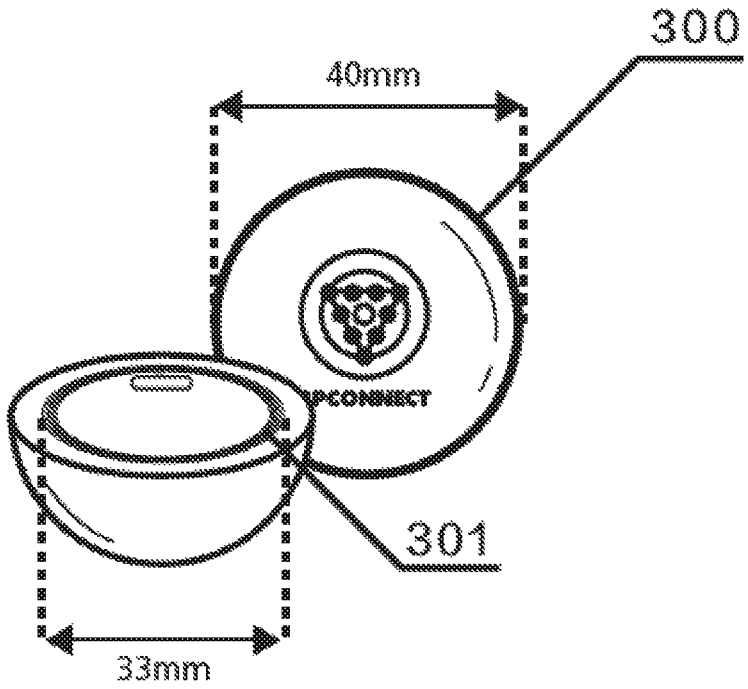

FIG. 4 illustrates a sectional diagram of a game ball in the ball-landing detecting sub-system of FIG. 2B.

Figure 5A:
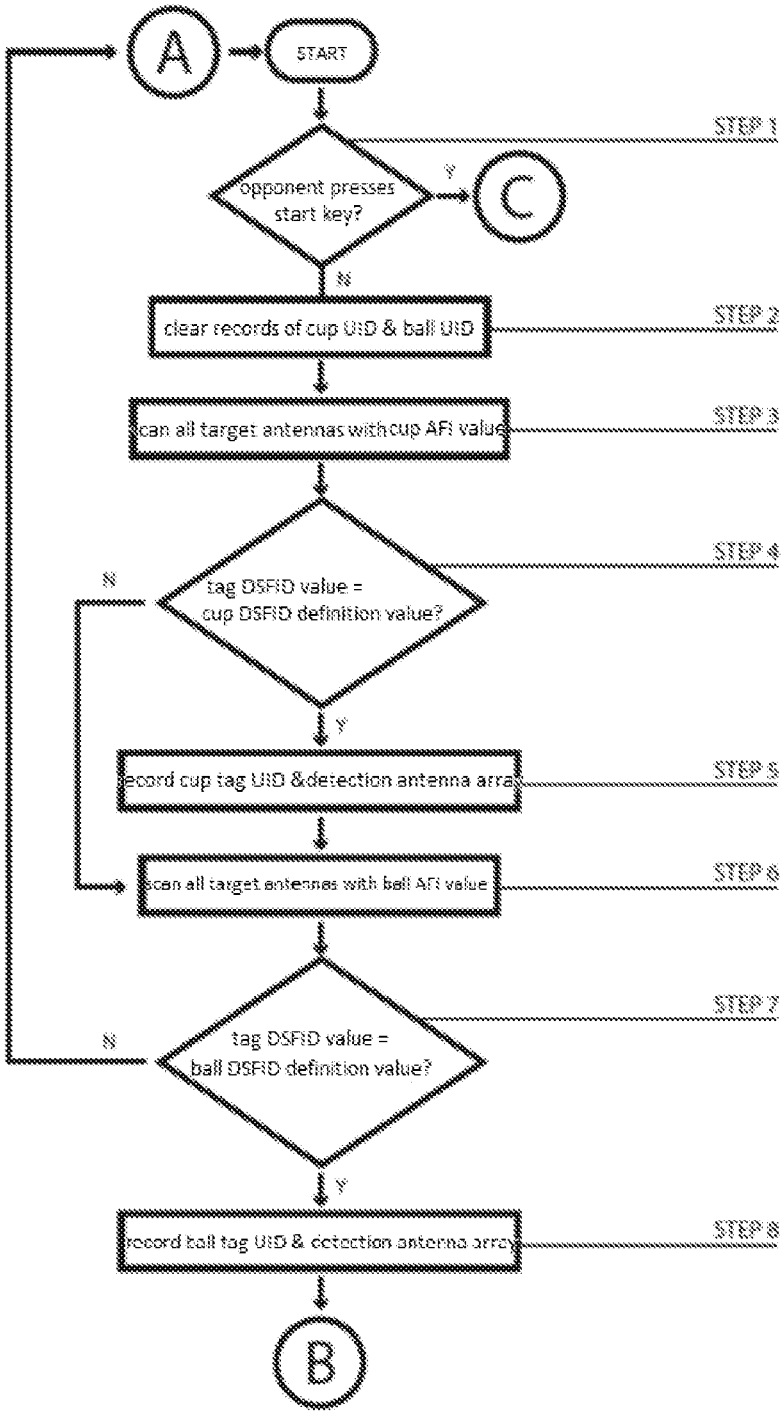
Figure 5B:
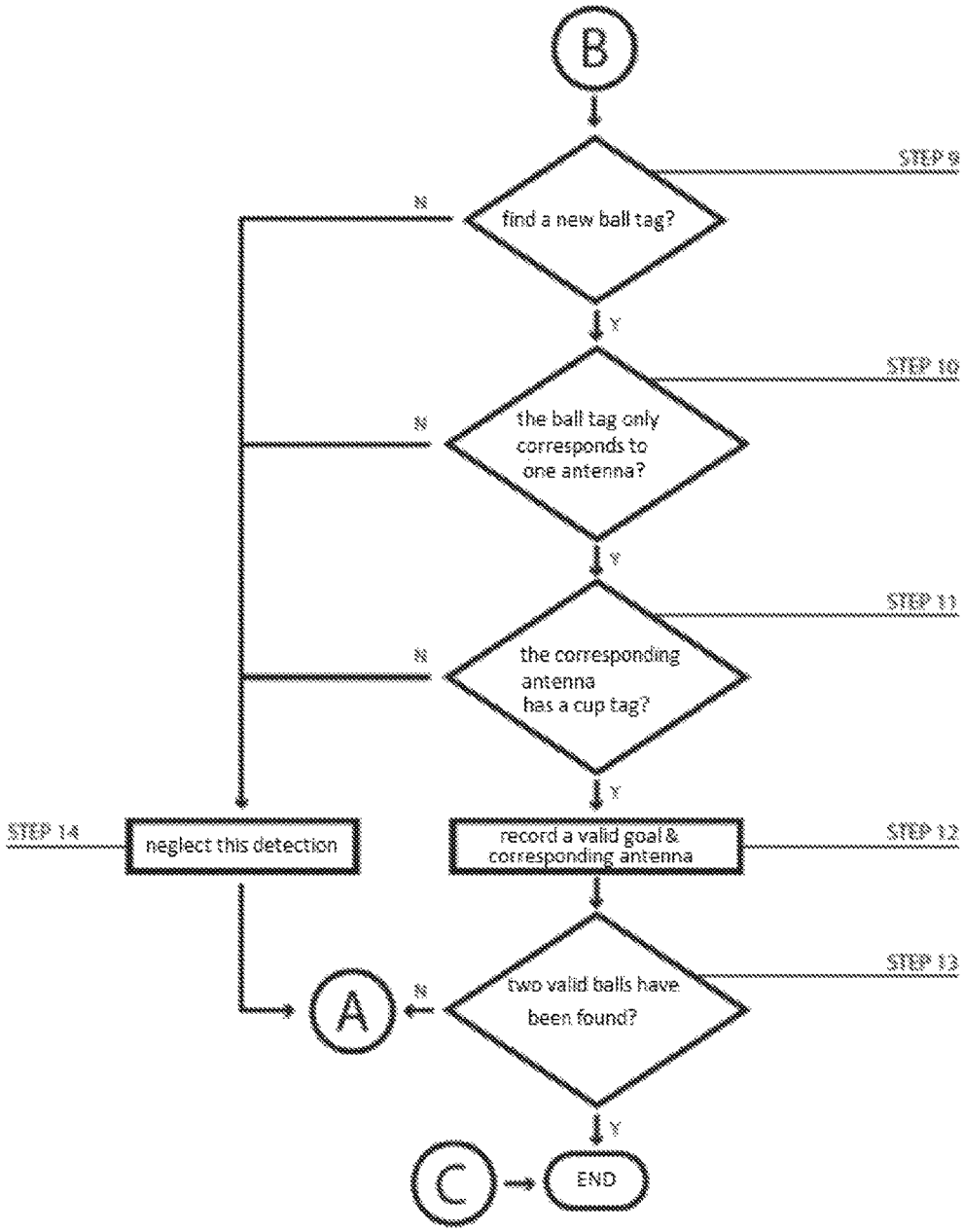

FIGS. 5A and 5B illustrate a flow diagram of a ball-landing detecting procedure of a beer pong game system according to the present invention.

Figure 6:
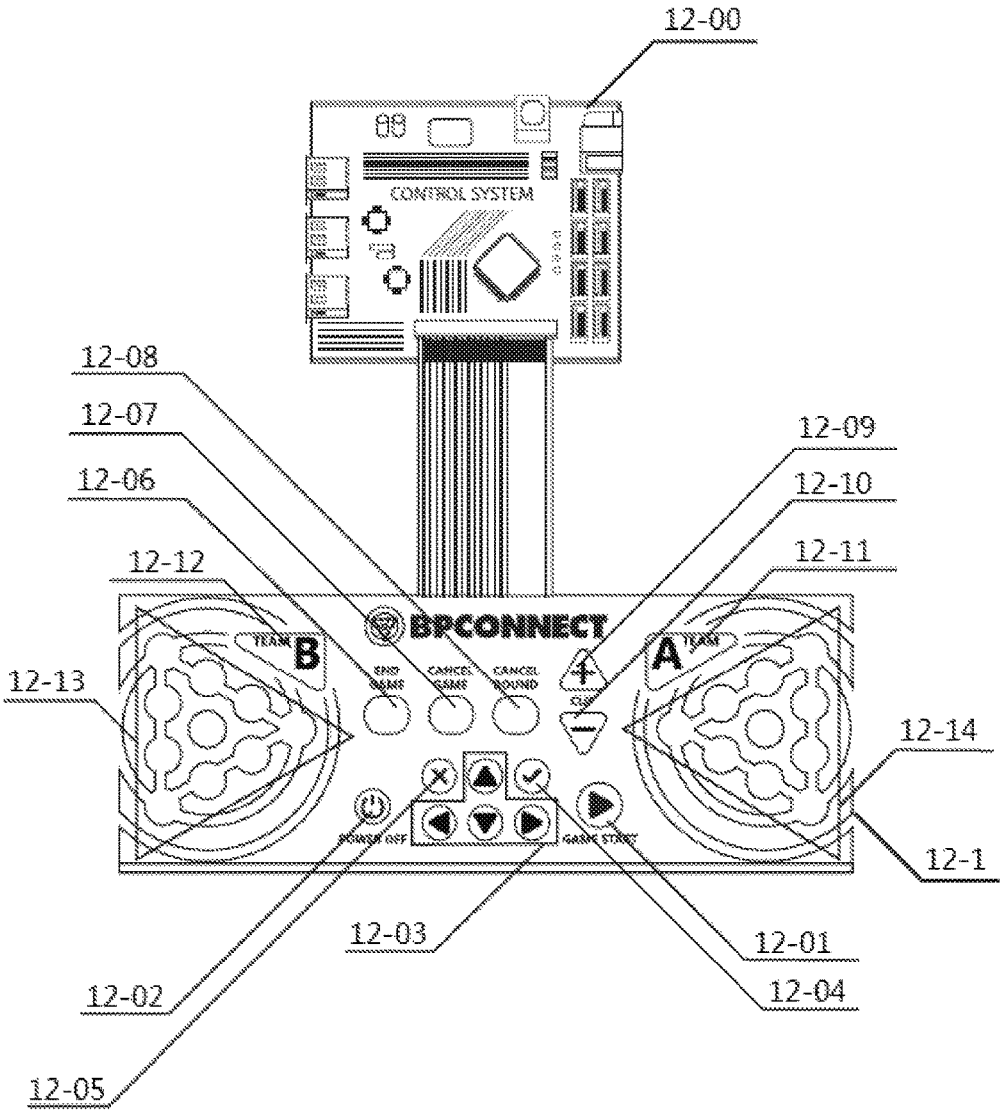

FIG. 6 illustrates a schematic diagram of an operating panel of a beer pong game system according to the present invention.

DETAILED DESCRIPTION OF THE PREFERRED EMBODIMENTS

Hereinafter, the technical contents, structural features, and to-be-achieved technical objectives and technical effects of the preferred embodiments of the present invention will be illustrated in detail with reference to the accompanying drawings.

Figure 1A:
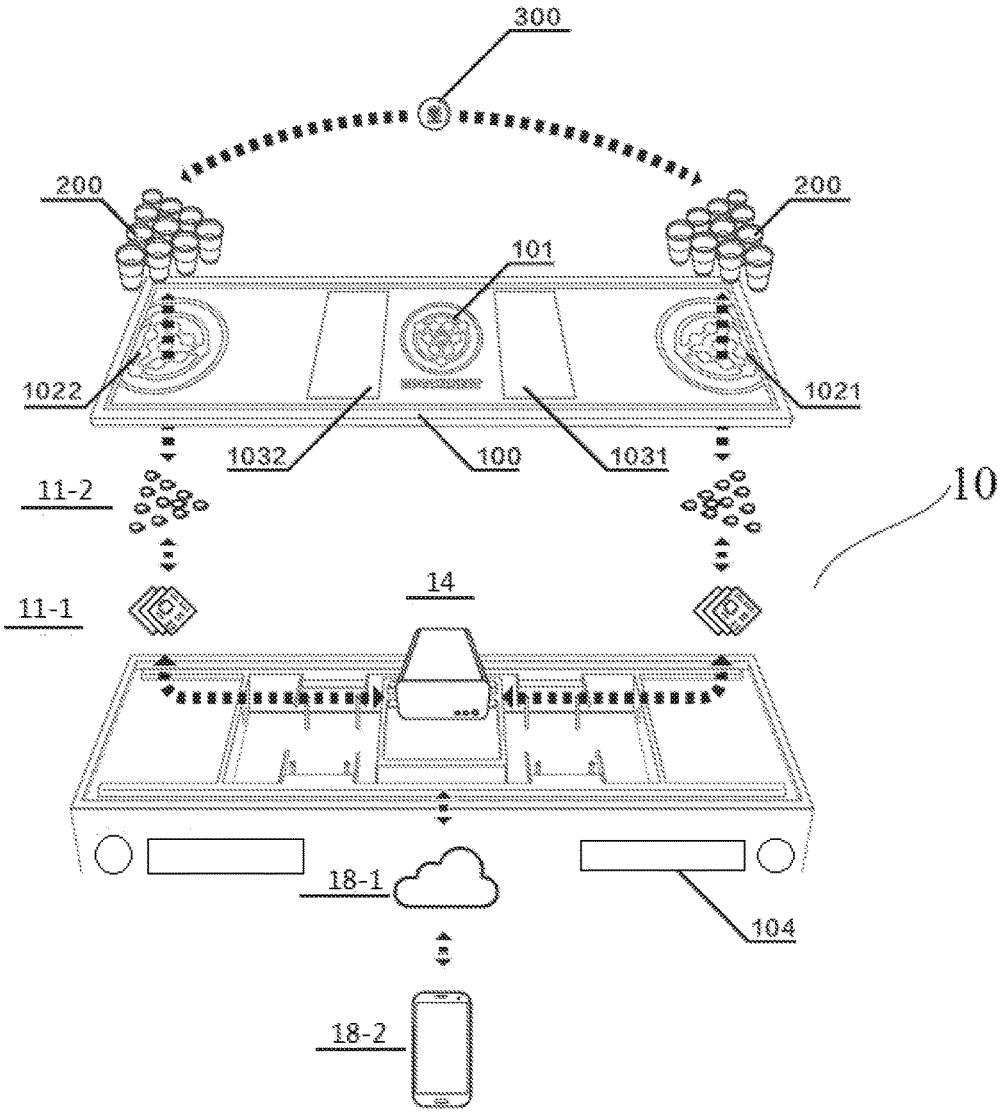
FIG. 1A illustrates an overall structural diagram of a beer pong game system according to the present invention.

FIG. 1A shows an overall structural diagram of an online beer pong game system 10 in an exploded state according to a preferred embodiment of the present invention. As illustrated in FIG. 1A, the online beer pong game system 10 comprises: an integrated game table 100 that integrates lighting, animation display, and sound effect; a plurality of game cups 200 with electronic tags, disposed on the game table 100 and capable of automatically sensing a ball-landing through a radio frequency identification (RFID) technology; and at least one game ball 300 with an electronic tag, used in mating with the game cups 200. An oblong tabletop of the game table 100 of FIG. 1A may be substantially differentiated into three zones, i.e., a game mark zone 101 located in a center of the tabletop; game working zones 1021, 1022 located at two ends of the tabletop; and information displaying zones 1031, 1032 disposed between the game mark zone 101 and the two game working zones 1021, 1022, respectively. When the beer pong game system 10 is in a standby state, the information displaying zones 1031, 1032 on the integrated game table 100 may display a ranking list based on historical game results, downloaded information about mobile phone applications, or advertisement information, and the game working zones 1021, 1022 of the integrated game table 100 highlight appropriate positions for placing the game cups 200. In addition, white and RGB colored LED belts are provided in the game mark zone 101, the game working zones 1021, 1022, and four edges of the oblong tabletop. These LED belts may emit light in accordance with patterns and colors customized by customers under control of a game control program installed in the computer. Besides, an LED word display screen 104 may be provided at a periphery of the integrated game table 100. The LED word display screen 104 may display rolling captions or advertisement information as needed under control of the computer. In addition, the game control program may also display information about players in the information displaying zones 1031, 1032 as needed and play voice files or the like from the computer through a signal amplifier or a loudspeaker, such that the game table 100 can integrate various functions such as lighting, animation display, and sound effect.

In a practical assembled state, a plurality of hardware involved in the online beer pong game system, such as a multi-channel RFID reader 11-1, a plurality of circular antennas 11-2, a computer 14 used as core control units, various kinds of driving circuit boards, a LED display, a matrix LED display screen, a power source, and an audio system, is all provided inside the integrated game table 100; therefore, they are all invisible in a normal use state. Further, it should be particularly noted that the computer 14 provided inside the integrated game table 100 for storing game data in real time may also work in coordination with a mobile application 18-2 (APP) through a cloud storage technology 18-1, so as to form a complete online beer pong game system.

Figure 1B:
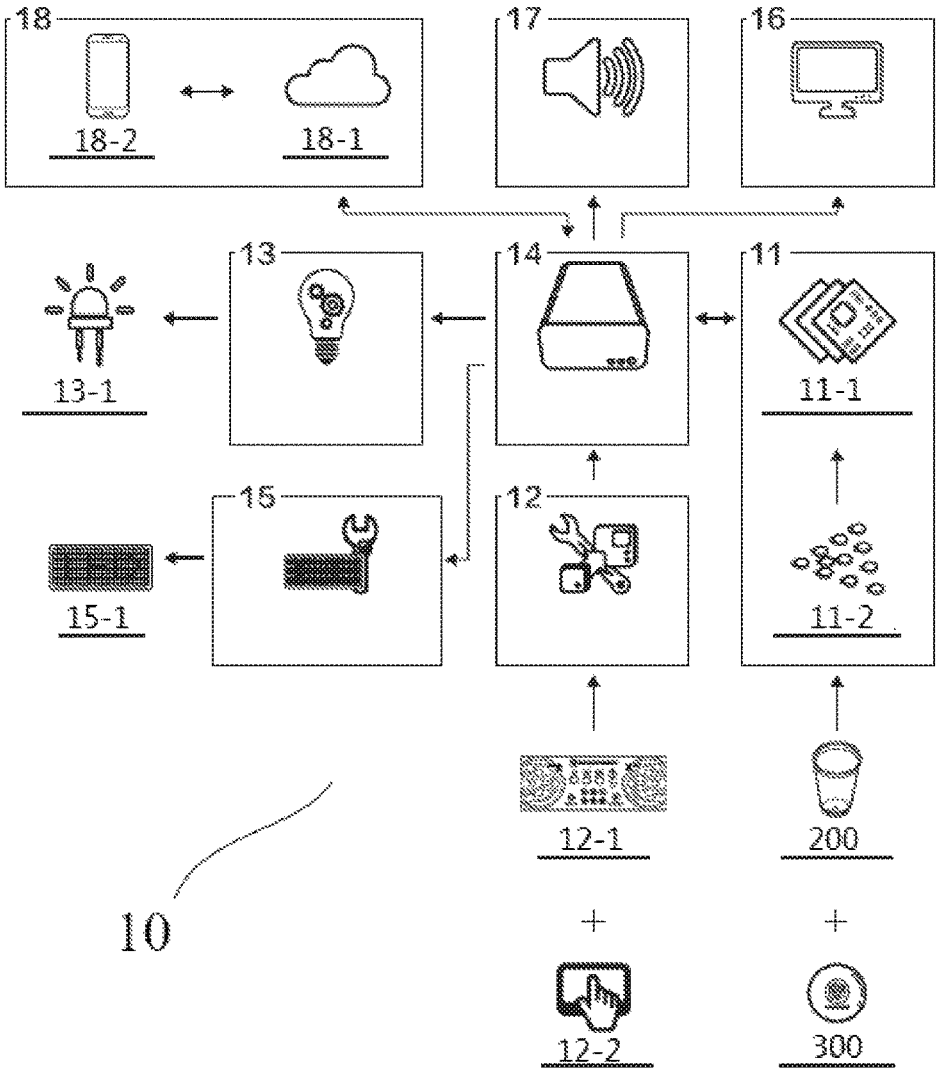
FIG. 1B illustrates a diagram of functional modules of a beer pong game system according to the present invention.

FIG. 1B illustrates a diagram of functional modules of respective sub-systems that constitute the online beer pong game system 10 of the present invention. As shown in FIG. 1B, the online beer pong game system 10 as a whole further comprises: an RFID ball-landing detecting sub-system 11 that detects electronic tags in the game cups 200 and game ball 300 using a radio frequency identification (RFID) technology, specifically through a RFID reader 11-1 and RFID antennas 11-2, to further determine mutual positional states of the game cups and the game ball, thereby implementing an automatic scoring function of the beer pong game; a key detecting system 12 that performs response or detection when a user operates keys on an operation panel 12-1 disposed at an external side/either end of the integrated game table 100 or external push buttons 12-2 disposed outside the integrated game table 100; a light control system 13 that controls lighting of various belts of LEDs 13-1 of the integrated game table 100; a computer 14 that controls actions of various parts of the entire beer pong game system; a word display screen control system 15 disposed on the LED word display screen 15-1 at the periphery of the integrated game table 100 for displaying relevant information; a display screen control system 16 that displays game information on the information displaying zones 1031, 1032 of the integrated game table 100; a music system 17 that provides a sound effect; and an online function system 18 that enables players to online participate in the beer pong game through the cloud storage technology 18-1 and the mobile phone application 18-2.

Here, it should be particularly noted that in the online beer pong game system 10, the inventors creatively implement an automatic scoring function (i.e., RFID ball-landing detecting sub-system 11) of the beer pong game using the radio frequency identification (RFID) technology, such that other sub-systems including the online function sub-system 18 will work in coordination under control of the computer, which makes traditional beer pong games practically electronic. For example, like other common electronic game machines, the online beer pong game of the present invention can automatically play music or display animation after a player successfully lands a ball so as to evoke game ambience and improve fun of game participation; further, by virtue of the cloud storage technology and the mobile phone application, spatial limitation of traditional beer pong games is broken, such that both competing parties can remotely participate in the beer pong game remotely like other online network games.

Hereinafter, the RFID ball-landing detecting sub-system 11 as a core of the present invention will be detailed in conjunction with the accompanying drawings. Considering that those skilled in the art can easily implement relevant functions of other sub-systems according to existing well-known technologies, specific structures of other sub-systems, which are not inventive focuses of the present invention, n will be omitted or only depicted briefly. Additionally, because the rules of beer pong games vary in different regions, details of the RFID ball-landing detecting sub-system 11 of the beer pong game system 10 of the present invention will be depicted in detail with an example in which both competing parties use 10 game cups, respectively (for a duet game, each team has two players, and each player shoots once; while for a solo game, the player shoots twice), i.e., at the start of the game, 10 game cups 200 are placed in a triangle formation as a whole in the game working zones 1021, 1022, respectively.

FIGS. 2A and 2B illustrate a schematic diagram of an RFID ball-landing detecting sub-system 11 of the beer pong game 10 of the present invention, wherein FIG. 2A shows a target position to be detected by the ball-landing detecting sub-system 11, and FIG. 2B shows connection relationships and positional relationships between various parts of the RFID ball-landing detecting sub-system 11. The figures only schematically show one game cup at position 10; in a practical game procedure, the number of game cups will change and the shape will be re-arranged according to game rules. It should be noted that although each competing party uses 10 game cups at the start of the game, when the game proceeds till only two game cups remain according to the game rules, the second cup has to be placed at position 11 shown in FIG. 2A; therefore, FIG. 2A shows 11 to-be-detected positions in total numbered 1-11 to be possibly detected by the RFID ball-landing detecting sub-system 11. Further, as illustrated in FIG. 2B, the RFID ball-landing detecting sub-system 11 comprises: an organic glass board 111 on a surface of which 11 circular RFID antennas 1111 are correspondingly disposed; and an RFID reader 112 that is connected to the 11 circular RFID antennas 1111 respectively through a co-axial cable and also serves as a multiplexer, the RFID reader 112 being further connected to a computer 15 via a USB cable so as to perform corresponding processing of data read by specific application software. The RFID ball-landing detecting system 11 further comprises: a plurality of game cups 200 with RFID tags being attached at bottoms thereof and at least one game ball 300 inlaid with an RFID tag. In order to simplify the depiction, the figures only schematically show one game cup 200 disposed at position 10, with two game balls 300 landed therein. Structural details of the game cups 200 and game balls 300 with RFID tags will be illustrated infra. In addition, in order to facilitate competitors to place the game cups at appropriate positions and enhance LED lighting effect, RGB lighting plates are also provided at the 11 to-be-detected positions, respectively, each RGB lighting plate comprising one lighting guide plate and two RGB colored LEDs. Those skilled in the art will easily understand that other manners may also be employed to eye-catchingly prompt the competitors to place the game cups at appropriate positions, e.g., attaching circular patterns at corresponding positions.

FIG. 3 illustrates a usage state diagram of a game cup 200 with two game balls 300 having been landed therein as used in the RFID ball-landing detecting sub-system 11. In a practical beer pong game competition procedure, utmost two game balls 300 will land in the game cup 200. As illustrated in FIG. 3, during the competition procedure, a water-level height in the game cup 200 is about 60 mm, a height of a center of the game ball 300 which first lands and drifts on a liquid surface of the game cup 200 is about 60 mm from a bottom of the cup, while a height of the center of the game ball 300 that lands later is about 90 mm from the bottom of the cup. Because a passive electronic tag 201 is embedded in the center of the two game balls 300, respectively, the height of the electronic tag in the game ball 300 at a lower position in the figure from the RFID height is about 60 mm, while the height of the electronic tag in the game ball 300 at a higher position from the RFID antenna is about 90 mm.

According to a preferred embodiment of the present invention, by selecting a 13.56 MHz high-frequency RFID product, a read range of the RFID reader 112, i.e., the working range of the RFID antenna 1111, is 0-11 cm. In this way, during the whole beer pong game procedure, with either one or two game balls 300 landing into the game cup 200, they can be reliably detected by a corresponding RFID antenna so as to determine a goal. If the game ball 300 misses the game cup 200 and directly falls onto the game table 100, it is simultaneously detected by a plurality of RFID antennas, and the RFID ball-landing detecting sub-system 11 determines a miss and does count a goal. Additionally, it should be noted that the game cup 200 is of a typical inverted truncated conical shape; a height of the cup body is about 135 mm, a diameter of the cup bottom is about 60 mm, and a water-proof plastic button-model circular tag 201 is attached at the bottom. Specifically, the circular tag 201 is a 7 mm circular tag in accordance with the ISO15693 standard. This size causes the electronic tag of the game cup 200 to be only located within the working zone of the corresponding RFID antenna, such that it will not be simultaneously detected by multiple RFID antennas.

FIG. 4 illustrates a sectional view of a game ball 300 in an RFID ball-landing detecting sub-system 11. As illustrated in FIG. 4, a standard diameter of the game ball 300 is 40 mm, with a coil tag 301, alternatively an inlay tag, being embedded in the center of the game ball 300. Specifically, the coil tag 301 is a 33 mm circular tag in accordance with the ISO15693 standard. It should be particularly noted that according to a preferred example of the present embodiment, regardless of the game cups 200 or game balls 300, they all select circular tags in accordance with the ISO15693 standard; however, the diameter of the electronic tag 201 of the game cup 200 is 7 mm, which is far smaller than the 33 mm diameter of the game ball 300. In this way, because the electronic tag 201 attached to the bottom of the game cup 300 has a smaller diameter, the RFID antennas 1111 at respective positions of the RFID reader 112 will not simultaneously detect the electronic tag 201 of the same game cup 200, such that it can be reliably determined whether the game cup 200 is present at a certain RFID antenna 1111. In addition, specific functions of respective electronic tags of the game cups 200 and game balls 300 during the ball-landing detecting procedure will be illustrated further infra.

It should be particularly noted that for the electronic tag 201 of the game cup 200 and the electronic tag 301 of the game ball 300, they are not only different in size (7 mm and 33 mm circular tags, respectively), but also different in the values defined by their contents. Specifically, their data storage format identifiers (DSFIDs) are different, so are their application family identifiers (AFIs). The RFID reader 112 determines whether they are game cups or game balls by the DSFID values. For example, the values are 0x0C and 0x34, respectively, while their AFIs are 0xC0 and 0x43, respectively, such that only a certain type of tag designated by the RFID reader 112 can be detected. Besides, the electronic tag for respective game cup 200 and game ball 300 has a unique identifier (UID), for recording correspondence relationships between the game cups 200 or game balls 300 and the target antennas respectively during the procedure in which the computer detects a RFID ball-landing, thereby accurately determining various ball-landing scenarios possibly appearing during the game process.

Hereinafter, illustration will be made to a working principle and a detecting procedure of the RFID ball-landing detecting sub-system 11. Firstly, the working principle of the RFID technology will be illustrated briefly. The RFID (Radio Frequency Identification) is a communication technology, which may identify a specific target and read/write relevant data through radio signals, without a need of establishing a mechanical or optical contact between the identifying system and the specific target. The RFID communication principle may be differentiated into electromagnetic sensing and microwave resonance. Generally, low-frequency and high-frequency RFIDs employ electromagnetic sensing: when current flows through an antenna of the reader, a magnetic field will be generated surrounding the antenna; at this point, once the RFID tag enters the magnetic field, an inducting current will be generated on the tag due to change of the magnetic field, which becomes a power source for the tag to work. Ultra-high-frequency and microwave RFIDs employ microwave resonance. An antenna of this type of readers has a two-pole formation (positive and negative poles); when current flows therethrough, an electric wave will be generated, such that a remote tag antenna will generate power due to energy of resonance. The brief introduction of the working principle above shows that the communication principle of the RFID is to generate electrical energy according to change in the electric field and magnetic field. However, the communication by electromagnetic sensing has a shorter transmission distance; if a long-distance communication is required, the communication mostly employs microwave resonance. According to the special application scenarios of the present invention, the working range of the reader antennas should not be too large so as to prevent misjudgment of ball-landing. Therefore, 13.56 MHz RFID products following the ISO15693 standard, which employ the electromagnetic sensing communication manner, are selected.

Next, the flow diagram of FIGS. 5A and 5B will be referenced to illustrate the RFID ball-landing detecting procedure of the beer pong game system of the present invention. In an actual beer pong game process, the number of competitors may vary according to game rules, and each game will have a plurality of rounds. Therefore, at the ease of understanding, the whole RFID ball-landing detecting procedure of the beer pong game system will be illustrated with an example in which both competing parties shoot twice for each round, respectively (for a duet game, each team has two players, and each player shoots once; while for a solo game, the player shoots twice).

When one competing party starts shooting by pressing a key on the operation panel or pressing an external push button disposed at two ends of the integrated game table, the game control program displays initial information of the game in an information displaying zone of the integrated game table, prompts by a picture or voice the competitor to shoot, and meanwhile initiates a timer to start timing of each round. It should be noted that in an actual game process, a special situation possibly occurs that a competing party misses the game cup 200 and totally falls beyond the game table 100, such that the RFID ball-landing detecting system cannot detect the electronic tag of the game ball 300 at all. In this case, the opponent party will press the shooting-start key at its end to re-initiate the ball-landing detecting procedure. Such special situation needs to be determined in the following procedure.

Firstly, the game control program installed in the computer first determines whether the opponent has pressed the shooting-start key (STEP 1). If determined as "Y (Yes)" in step S1, the ball-landing detecting procedure of this time will be directly terminated; otherwise, the game control program initializes the ball-landing detecting procedure, i.e., clearing records of the UID of the electronic tag of the game cup (hereinafter shortly referred to as cup tag) and the UID of the electronic tag of the game ball (hereinafter shortly referred to as ball tag) (STEP 2). Next, the game control program scans all target antennas from position 1 to position 11 using cup AFI (application family identifier) values (STEP 3), and proceeds to a next step to determine whether any cup tag is found, so as to determine whether a cup tag exists in working zones of the target antennas. Specifically, it is determined whether the DSFID (data storage format identifier) value of the detected electronic tag is equal to a DSFID defined value of the game cup (STEP 4). If determined as "Y (Yes)" in step S4, the game control program records the detected cup tag UID and the corresponding detection antenna array (STEP 5). If determined as "N (No)" in step S4, the game control program skips step S5 to enter a next step of scanning all target antennas from position 1 to position 11 using ball AFI values (STEP 6). Then, the game control program enters a next step to determine whether any ball tag is found to determine whether a ball tag is present in the working zones of the target antennas. Specifically, it is determined whether the DSFID (data storage format identifier) value of the detected electronic tag is equal to a DSFID defined value of the game ball (STEP 7). If determined as "Y(Yes)" in step S7, the game control program records the detected ball tag UID and the corresponding detection antenna array (STEP 8); if determined as "N (No)" in step S7, the game control program returns to the flow to start a next ball-landing detecting cycle.

Here, it should be particularly noted that according to the game rules, both competing parties shoot twice for each round, respectively; therefore, the game control program needs to further determine whether a new ball tag is found in one ball-landing detecting cycle, i.e., determining the ball tag detected at the present time is a firstly found new ball tag or a previously detected old ball tag (STEP 9). If determined as "N (No)" in step S9, the game control program neglects this detection result (STEP 14) and returns to start a next ball-landing detecting cycle. If determined as "Y(Yes)" in step S9, the game control program further determines whether there is only one antenna corresponding to the ball tag (STEP 10), and then immediately determines whether the corresponding antenna has detected a cup tag (STEP 11). Here, it should be noted that the determining in step S10 is to check whether the game ball lands in the game cup. If the game ball lands in the gap cup, the water level in the game cup causes a distance between the game ball and the antenna to be about 6-7 cm. This distance only enables a same game ball to be detected at one antenna position; if the cup tag is simultaneously present on the antenna, it may be further determined that the game ball lands in the game cup to thereby determine a valid goal. In the case of absence of the cup tag, the game ball might be lower than 6 cm and detected by multiple antennas simultaneously. At this point, the system will determine that the game ball misses the game cup and then does not count a goal; even there is only one antenna detecting the game ball, because no cup tag is present within the working range on the antenna, the detecting result will also be deemed as missing and then neglected.

If determined as "N(No)" in step S10 or step S11, the game control program neglects this detection result (STEP 14) and returns to start a next ball-landing detecting cycle. If determined as "Y(Yes)" is step S10 and step S11, the game control program will record a valid ball-landing and the corresponding antenna (STEP 12). Next, the game control program will enter the next step to determine whether two valid ball-landings have been found (STEP 13). If determined as "Yes (Y)" in step S13, the game control program terminates this ball-landing detecting procedure and determines a game score; otherwise, the system returns to start a next ball-landing detecting cycle, till the participating counterpart presses the shooting-start key according to system prompt. What has been discussed above is the entire flow of the RFID ball-landing detecting procedure of the beer pong game system of the present invention.

According to the embodiments of the present invention as discussed above, those skilled in the art easily appreciate that on the basis of implementing an automatic ball-landing detecting function of the beer pong game system using the RFID core technology, a traditional beer pong game can be granted with a full-automatic scoring function so as to be actually electronic, such that it can automatically play music or display animation for example after a player successfully lands a ball to evoke game ambience and improves fun of game participation, like other common electronic games.

Hereinafter, FIG. 6 will be referenced to illustrate relevant functions of specific operations of an operation panel of the online beer pong game system based on an automatic goal detection function, wherein FIG. 6 is a schematic diagram of the operation panel of the beer pong game system.

As illustrated in FIG. 6, an operation panel disposed at one side of the integrated game table 100 has a plurality of keys. An operation panel control system 12-00 in the figure as a key input control system controls the whole process of the online beer pong game system in response to competitors' operating relevant keys during the game process. Hereinafter, usage of respective keys shown in FIG. 6 will be briefly explained.

In a key group provided at a lower part of the operation panel 12-1, "GAME START" key 12-01 is for starting and pausing a game. Specifically, when a competitor first presses the "GAME START" key 12-01, the game control program installed in the computer 14 will initiate a game start mode, accompanied with a start animation having light and sound effects. At this point, the game control program lights the LED belts disposed in the game mark zone 101, game working zones 1021, 1022, and four edges of the oblong table face with a pattern and color customized by a customer through a light control system 13. Meanwhile, the game control program plays a relevant audio file from an audio port of the computer 14 through a music system 17. In addition, "POWER OFF" key 12-02 is for cutting off a power supply of the whole beer pong game system so as to make it stop work; when this key 12-02 is simultaneously pressed with the "GAME START" key 12-01, the game and the computer power will be started. In addition, selection keys 12-03 with up, down, left, and right directions are for selecting the number of competitors, and confirm or cancel is made by pressing the "✓" key 12-04 or the "✗" key 12-05.

In a key group provided at an upper part of the operation panel, the "END GAME" key 12-06 is for ending the present game and calculating ball-landing scores. The "CANCEL GAME" key 12-07 is for terminating and cancelling the score of the present game. The "CANCEL ROUND" key 12-08 is for cancelling all ball-landings of the present round. The "+" key 12-09 and the "−" key 12-10 are for selecting to increase or decrease the number of game cups used in the game procedure. In addition, the "Team A" key 12-11 and the "Team B" key 12-12 in triangular formation at two sides of the upper part of the operation panel are for the competing parties to select starting shoot in each round. In order to facilitate competitors' operation, external push buttons are provided at two ends of the integrated game table. Their functions correspond to the two keys, respectively.

Besides, as an extra remedial measure when automatic ball-landing detection fails to work, an administrator or a player may, for example, press a ball-landing key at a corresponding position on the operation panel to count it as a ball-landing score in the game cup at the position. It should be particularly noted that the ball-landing remedial operation corresponding position 11 of the game table may be implemented alternately by pressing the key 12-13 or 12-14 at position 2 or position 3 on the operation panel 12-1, because according to the beer pong game rule, when a game cup is present at position 11, no game cup will be placed at position 2 or 3.

Finally, like various kinds of common mobile phone applications, a mobile phone application (BPCONNECT) dedicated for the online beer pong game system 10 includes a plurality of simple and clear user operation interfaces. After a competitor download the mobile phone application and scan a specific two-dimensional code (QR Code) generated for each competitor and each game using a smart phone before start of each game, competitor profiles and the current competition will be associated through a cloud storage technology, thereby enabling online or remote (optionally equipping a camera) participation in the beer pong game. In this way, the score of a competitor upon each time of participating in the online beer pong game will be recorded in real-time, and he/she will know his/her own scores and ranking through the mobile phone application at any time. Additionally, those skilled in the art will easily appreciate that other functions may also be easily added in the mobile phone application according to various needs of a game user, thereby significantly enriching user experience.

According to the embodiments discussed above, to those skilled in the art, by saving all information (including scores, competitors, game address, etc.) related to the game in the computer of the beer pong game system, and performing remote sharing through the cloud storage technology and the smart phone application, spatial restrictions of a traditional beer pong game may be broken, such that like other online network games, competitors may not only online participate in the beer pong game, but also may remotely participate in the beer pong game even they are in different places. Additionally, competition data such as a competitor's present game result may be stored in the cloud in real-time, such that ranking and grading are enabled according to the game results like many online network games.

What have been disclosed above are only preferred embodiments of the present invention. Of course, equivalent changes within the patent scope of the present invention application still fall within the scope of the present invention. It should be understood that the depictions above are intended to illustrate, not for limitation. For example, the embodiments above (and/or other aspects) may be combined with each other for use. In addition, according to the teachings in the present invention, many transformations may be made to adapt specific situations or materials without departing from the scope of the present invention. By reading the depictions above, many other embodiments and transformations within the scope and spirit of the claims are obvious to those skilled in the art.

What is claimed is:

1. An automatic scoring system for a beer pong game to implement an automatic scoring function of the beer pong game using a radio frequency identification (RFID) technology, comprising:

a game table equipped with an RFID reader and a plurality of RFID antennas;

a plurality of game cups with electronic tags being attached at bottoms thereof;

at least one game ball inlaid with an electronic tag; and a computer that processes data read by the RFID reader from the electronic tags and controls a scoring procedure of the beer pong game, wherein the RFID antennas are placed at a plurality of predetermined positions in a game zone of the game table, the plurality of predetermined positions corresponding to possible positions of the game cups placed according to game rules, wherein one of the RFID antennas detects location of the at least one game ball by detecting the data of the electronic tag of the at least one game ball and the data of an electronic tag of one of the game cups in which the at least one game ball is placed, and the computer performs the scoring procedure according to the data of the electronic tag of the at least one game ball and the data of an electronic tag of one of the game cups in which the at least one game ball is placed read by the RFID reader.

2. The automatic scoring system for a beer pong game according to claim 1, wherein the electronic tags of the game cups are dimensioned to be positioned only in working zones of the corresponding RFID antennas; the electronic tag of the game ball is dimensioned such that the electronic tag of the game ball that lands into the game cup while drifts on a liquid surface is only positioned within a working zone of the corresponding RFID antenna.

3. The automatic scoring system for a beer pong game according to claim 2, wherein respective electronic tags of the game cups and the game ball are all 13.56 MHz high-frequency passive tags following the ISO15693 Standard, and dimensions of the electronic tags of the game cups are far smaller than a dimension of the electronic tag of the game ball.

4. The automatic scoring system for a beer pong game according to claim 3, wherein a data storage format identifier (DFSID) and an application family identifier (AFI) of the electronic tags for the game cups are different from those of the electronic tag for the game ball, such that the RFID reader can only read the electronic tags of the game cups or the electronic tag of the game ball, and can determine, based on information returned from an electronic tag, whether the electronic tag belongs to the game cups or the game ball.

5. The automatic scoring system for a beer pong game according to claim 4, wherein if the RDIF reader can simultaneously identify the electronic tags of the game cups and the electronic tag of the game ball, the computer determines that the game ball lands in the game cup and automatically scores according to the game rules.

6. An online beer pong game system, comprising the automatic scoring system for a beer pong game according to claim 4, wherein game data are obtained in real-time from a computer of the automatic scoring system using a cloud storage technology and a mobile phone application, such that competitors of the beer pong game can online participate in the game, track game scores and statistics, compare results with other competitors on a global scale.

7. A beer pong game cup for the automatic scoring system for a beer pong game according to claim 4, wherein the electronic tags of the game cups are respectively attached at a bottom of the game cups.

8. A beer pong game ball for the automatic scoring system for a beer pong game according to claim 4, wherein the electronic tag of the beer pong game ball is embedded inside the beer pong game ball.

9. A beer pong game table for the automatic scoring system for a beer pong game according to claim 4, wherein the beer pong game table is equipped with the RFID reader and the plurality of RFID antennas.

10. An online beer pong game system, comprising the automatic scoring system for a beer pong game according to claim 2, wherein game data are obtained in real-time from a computer of the automatic scoring system using a cloud storage technology and a mobile phone application, such that competitors of the beer pong game can online participate in the game, track game scores and statistics, compare results with other competitors on a global scale.

11. An online beer pong game system, comprising the automatic scoring system for a beer pong game according to claim 1, wherein game data are obtained in real-time from a computer of the automatic scoring system using a cloud storage technology and a mobile phone application, such that competitors of the beer pong game can online participate in the game, track game scores and statistics, compare results with other competitors on a global scale.

12. The online beer pong game system according to claim 11, further comprising a light control sub-system, an information displaying sub-system, and/or a sound control sub-system to correspondingly implement lighting, animation display, and/or sound effect in mating with scoring results of the automatic scoring system.

* * * * *